United States Patent [19]

O'Brian et al.

[11] Patent Number: 4,822,314

[45] Date of Patent: Apr. 18, 1989

[54] INTERLOCKING CONTAINER AND TOY BLOCK SETS

[76] Inventors: Edward D. O'Brian, 19702 Shorecliff La., Huntington Beach, Calif. 92648; William M. Plachy, 346 Camino Redondo, San Marcos, Calif. 92069

[21] Appl. No.: 65,587

[22] Filed: Jun. 23, 1987

[51] Int. Cl.[4] ..... A63H 33/04; A63H 33/08

[52] U.S. Cl. ..... 446/75; 446/77; 446/118; 446/128; 206/511; 206/216

[58] Field of Search ..... 446/77, 75, 128, 118, 446/106, 124, 125, 85, 108; 206/216, 508, 509, 511; D21/108

[56] References Cited

U.S. PATENT DOCUMENTS

| | | | |
|---|---|---|---|
| 297,308 | 4/1884 | Stranders | 446/75 |
| 2,020,562 | 11/1935 | Miller | 446/127 |
| 3,274,727 | 9/1966 | Zander | 446/118 |
| 3,359,677 | 12/1967 | Hepler | 446/70 |

FOREIGN PATENT DOCUMENTS

| | | | |
|---|---|---|---|
| 660489 | 11/1951 | United Kingdom | 446/75 |

OTHER PUBLICATIONS

PCT WO82/02341, Pub. 7, 1982, Gram.
PCT WO86/03133, Pub. 6/5/1986, Tapdrup.

*Primary Examiner*—Mickey Yu
*Attorney, Agent, or Firm*—Edward D. O'Brian

[57] ABSTRACT

A construction set including a set of interlocking blocks and a container for the set which can be constructed so that at least a part of the container interlocks with the blocks. As a consequence, a structure may be erected using both the blocks and the container. Such a structure is desirable because it is significantly larger than a structure which could be created from the set of blocks alone.

12 Claims, 3 Drawing Sheets

INTERLOCKING CONTAINER AND TOY BLOCK SETS

BACKGROUND OF THE INVENTION

The invention set forth in this specification pertains to new and improved container and toy block sets. These sets are considered to be more desirable for play purposes than prior related container and toy block sets.

The term "container" is used in this specification to designate either a receptacle and a closure for the receptacle or so as to designate such a receptacle without any separate closure for use with it. Thus, this term "container" is used hereinto designate an item such as a wide variety of different boxes, pails and the like as well as such items including lids or covers for such receptacles. Such receptacles are often used to hold parts or blocks which are shaped or otherwise constructed so as to include interlocking elements enabling such blocks to be assembled together into what may be referred to as an "assembly". Such an assembly is most commonly some sort of a fanciful shape which appeals to a child who has created it. There are many types of such blocks; many different types of interlocking elements are used with or on them so that they can be assembled into structures or assemblies which are relatively resistant to being knocked down.

Because of this the term "blocks" is used in this specification in a rather broad, generic sense. It is intended to include toy building elements as generally rectangular hollow blocks having cylinders arranged in a pattern on one of their surfaces in such a manner that the cylinders on one block can be frictionally fitted within the interior of an adjacent block. It is also intended to include comparatively long, notched, rod-like or log elements capable of being assembled in the manner in which log cabins were once constructed. The term "blocks" as used herein is also intended to cover a wide variety of other reasonably related construction toy elements having different types of shapes and using differet interlocking structures.

Such blocks are commonly sold in containers as indicated in the preceding so that in effect the container used and the blocks sold within it constitute what may be referred to as a "set". Normally the container in such a set is constructed so that it can serve as a place for a child to store the blocks originally sold in it during the times when such blocks are not being employed for play purposes. During the use of the blocks of such a set a child will frequently desire to make as large an assembly of blocks as reasonably possible. Frequently a child will also desire to protect and store a partially completed or a fully completed assembly of the blocks.

Because of the fact that the containers used with such sets have been constructed so as to serve only as containers it has not been possible to effectively use such a container as a part of an assembly created with such blocks so as to increase the dimensions of such an assembly by in effect supplementing the blocks in the set by using the container as a part of the set. Further, the containers of known sets have not been especially constructed for use in protecting and storing an assembly of blocks as, for example, when it may be desired to complete such an assembly at a subsequent time.

BRIEF SUMMARY OF THE INVENTION

Broadly, the invention is intended to supply new and improved container and toy blocks sets. More specifically an object of the invention is to provide such sets which are of such a nature that either all or a part of the containers used in the set can be incorporated into as assembly of the blocks originally packaged in the container so as to make it possible to construct an assembly which is significantly larger than one constructed using only the blocks in the set. Another objective is to provide sets as noted which can be used in storing an assembly made form the blocks in the set. Further, the invention is intended to provide sets as noted which are not significantly more expensive than prior related sets not having the capability of the sets of the invention.

In accordance with this invention these various objectives are achieved by providing in the combination of a container, said container comprising a receptacle and a lid for said receptacle, and a series of blocks, each of said blocks including interlocking means, said interlocking means on said blocks being of such a character as to enable said blocks to be assembled into an interlocked assembly of said blocks the improvement which comprises: an external surface on a part of said container including other interlocking means which are capable of interlocking with said interlocking means on said blocks so as to be assembled into an interlocked assembly incluing both said part and said blocks.

BRIEF DESCRIPTION OF THE DRAWINGS

Because of the nature of this invention it is best more fully described with reference to the accompanying drawings in which.

Figure 1:
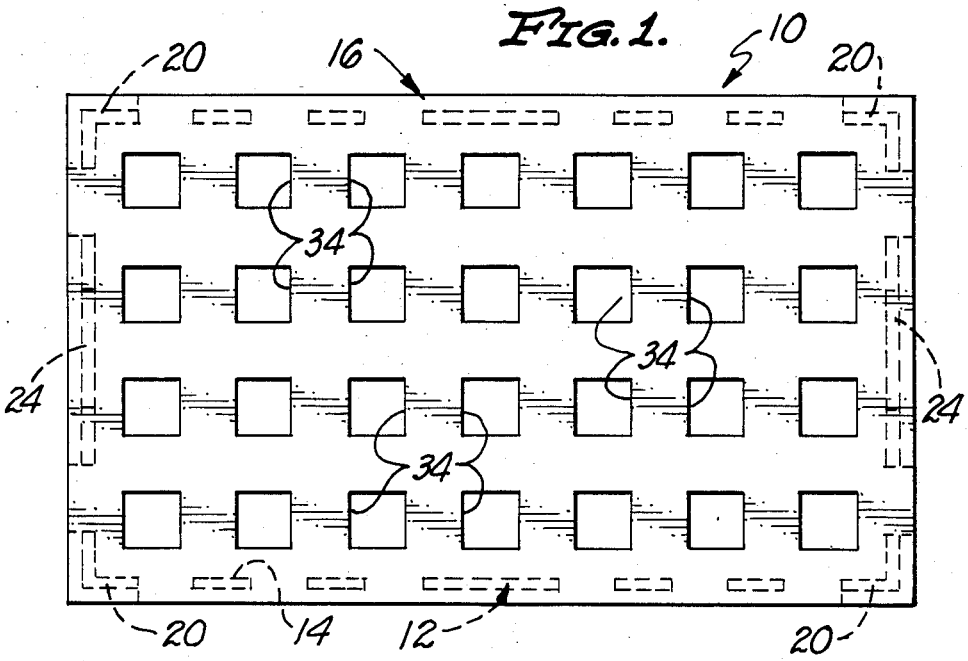
FIG. 1 is a top plan view of a presently preferred container including a crate-like receptacle and an assembled lid which is intended to be used in a container and block set in accordance with the invention.

The two different presently preferred containers shown in the drawings are constructed so as to employ the operative concepts or principles of the invention as are set forth and defined in the appended claims. Those skilled in the toy block will field will realize that a wise variety of differently appearing and differently constructed container and block sets can be constructed using these concepts or principles on the basis of the disclosure of this specification. For this reason the invention is not to be considered to be limited to precise structures as shown.

DETAILED DESCRIPTION OF THE PREFERRED EMBODIMENTS

In FIG. 1 of the drawing there is shown a container 10 in accordance with the present invention which includes a generally rectangular receptacle 12 having a normally open top 14. This top 14 is adapted to be closed off through the use of a cover or lid 16. The receptacle 12 and the lid 16 can conveniently be formed of the same or different comparatively rigid or self supporting polymers by known, conventional techniques. If the container 12 is a comparatively large container it may be preferable to form the receptacle 12 and the lid 16 out of wood.

The receptacle 12 has a base or bottom 18 which carries a series of four upstanding corner posts 20, a series of slats 22 and end panels 24. These panels 24 are located between two of the slats 22 as shown. Small flanges 26 capable of being used as handles are located at the tops of the panels 24 so as to extend parallel to the bottom 18. If desired a reinforcing band 28 as shown in phanton can be located parallel to the bottom 18 in order to reinforce the corner posts 20 and the slats 22. Normally such a band 28 will not be needed in those cases where the container 10 is of a comparatively small size.

The lid 16 preferably includes corner angles 30 which frictionally engage the corner posts 20 so as to hold the lid 16 in place on the receptacle 12 in such a manner that it can be easily removed. If desired, conventional detents or latches can be employed to hold the lid 16 in place. Notches 32 may be provided in the bottom 18 to facilitate molding of the receptacle 18. Except for the presence of these notches 32 the bottom 18 and the lid 16 are identical.

Figure 2:
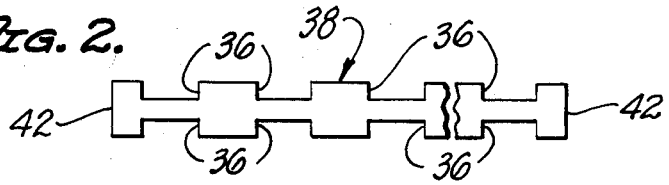
FIG. 2 is a side elevational view of one type of block which is capable of being used with the container shown in the preceding figure.
Figure 3:
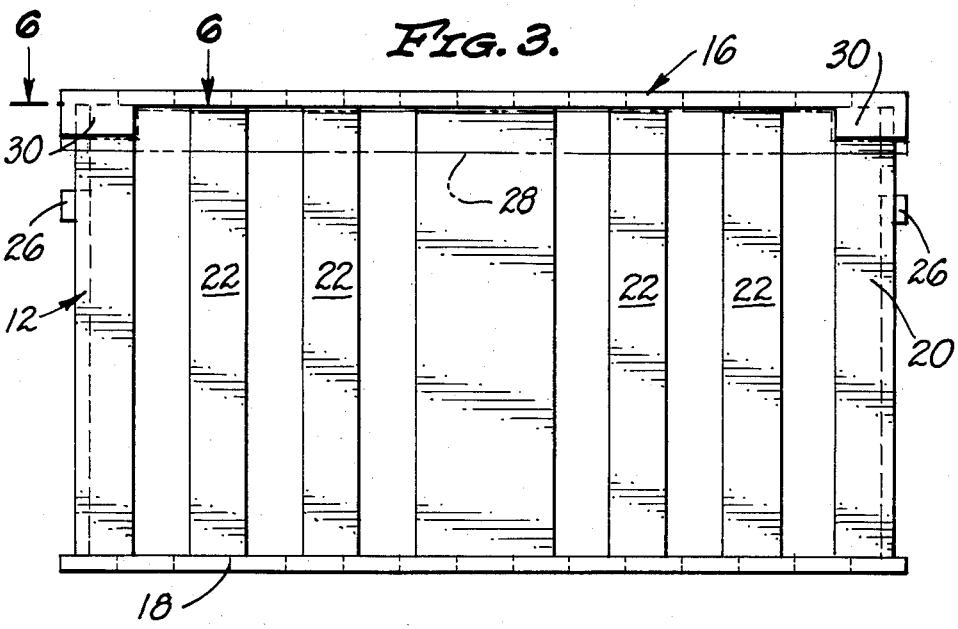
FIG. 3 is a side elevational view of the container shown in FIG. 1, the other side elevational view of the container being the mirror image of this view.
Figure 4:
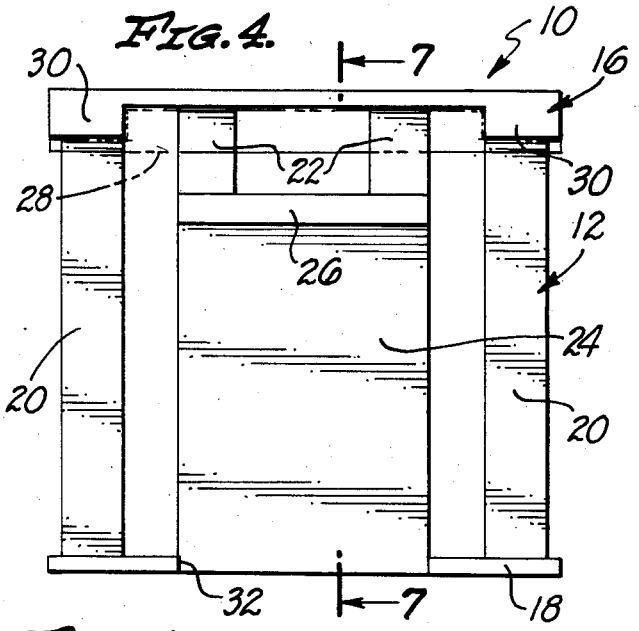
FIG. 4 is an end elevational view of the container shown in FIG. 1, the other end elevational view of the container being a mirror image of this view.
Figure 7:
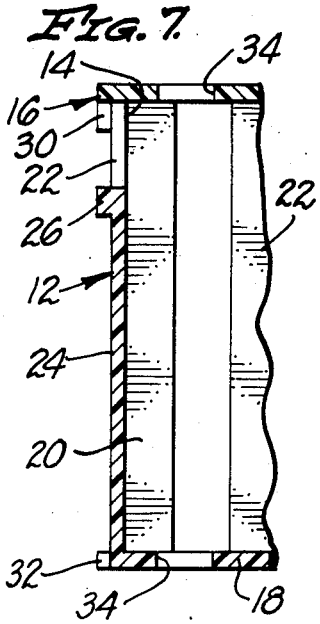
FIG. 7 is a partial cross-sectional view taken at line 7—7 of FIG. 4.
Figure 5:
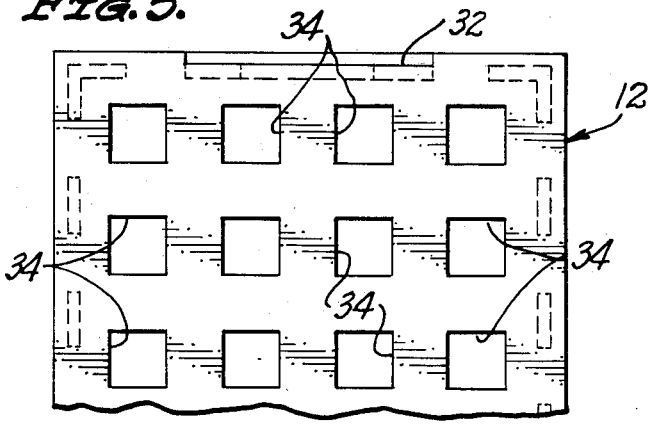
FIG. 5 is a bottom plan view of the container shown in FIG. 1.
Figure 6:
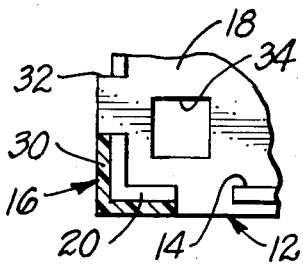
FIG. 6 is a partial cross-sectional view taken at line 6—6 of FIG. 3.

It is presently preferred to construct 10 so that both the lid 16 and the bottom 18 are provided with identical square holes 34 as shown. These holes 34 are located in rows (not separately numbered) in a two dimensional rectangular pattern in which the distances between the holes 34 is slightly less than the side dimension of any of the holes 34. As a consequence of such spacing the holes 34 will interfit with or accommodate notches 36 in elongated, log-like toy blocks 38 such as the block 38 shown in FIG. 2.

Figure 8:
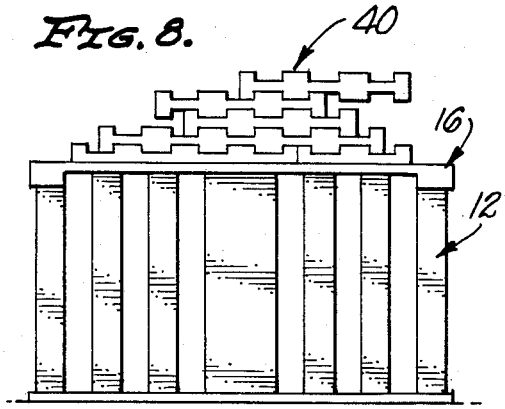
FIGS. 8, 9, and 10 are diagrammatic views showing the various uses of a container as shown in FIG. 1.
Figure 9:
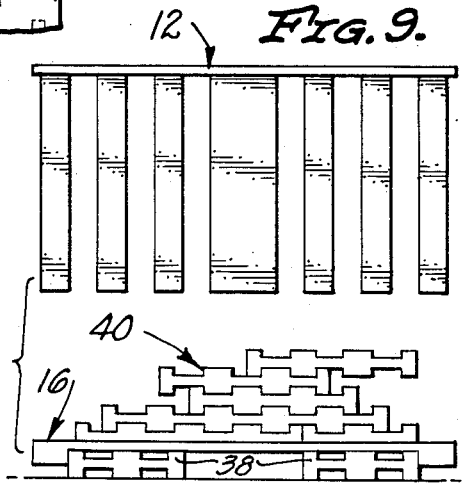
Figure 10:
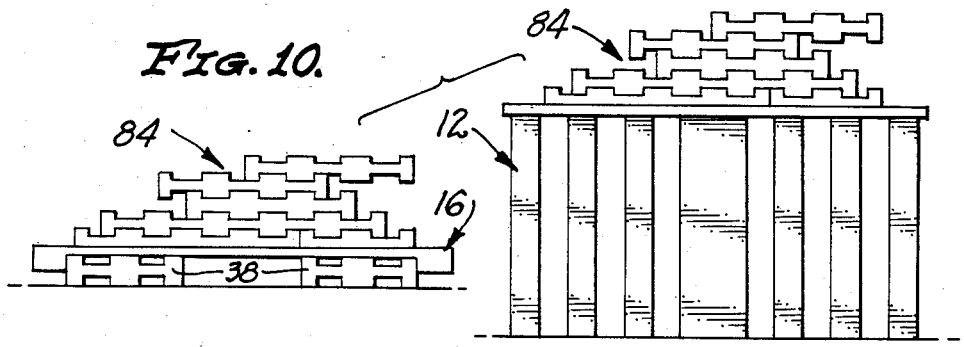

As a result of such accommodation various assemblies 40 of such blocks 38 as indicated in FIGS. 8 and 9 can be constructed directly on the lid 16 or the bottom 18 either when the container 10 is assembled with the lid 16 in place as shown or when the lid 16 has been removed from the receptacle 12. When the lid 16 has been removed from the receptacle 12 it is considered preferable to support the lid 16 on several of the blocks 38 as indicated in FIG. 9 so as to achieve a "good" interlock between the blocks 38 and the lid 16. Further in this case the receptacle 12 can be inverted on the lid 16 to protect an assembly 40. If desired, an assembly 40 of the blades 38 can be conveniently interfitted with both the lid 16 and the receptacle 12 as shown in FIG. 10.

The receptacle 12 is also preferably formed so that the corner posts 20 and slats 22 are spaced in such a manner as to accommodate or receive these same notches 36. If for any reason the complete container 10 or the receptacle 12 is used or is intended to be used on its side or end. To facilitate such use it would be possible to form the container 10 so that all of its surfaces were provided with holes 34 in a pattern as indicated. This is not considered necessary. It is also considered that this would unnecessarily complicate the manufacture of the receptacle 12.

The particular blocks 38 shown are of a square cross-sectional configuration and are provided with the notches 36 as shown so that they can be interlocked together in a conventional or known manner to form various assemblies. It is a matter of choice as to whether or not the blocks 38 are solid or are hollow and as to whether or not the notches 36 are shaped so as frictionally fit or closely fit together. It is possible to use blocks 38 with the invention which only have a single notch 36 or which only have a pair of notches 36 (not separately illustrated) with a notch 36 of each pair adjacent to each end 42 of a block 38.

Preferably the blocks 38 are used as a set (not separately numbered) which will fill the receptacle 12 when the blocks 38 of the set are neatly stacked together so as to extend in the same direction within the receptacle 12. These blocks 38 can be of the same or various different lengths. If desired somewhat related blocks 38 of different types can, of course, be employed together. The important thing is for the blocks 38 to be able to be used so that they interlock together and with the container 10 as a result of the spacing of the holes 34 and preferably also of the posts 20 and the slats 22.

Figure 11:
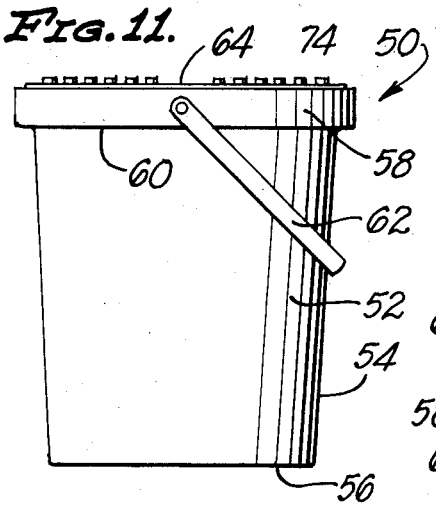
FIG. 11 is a side elevational view of another presently preferred embodiment of a container including a pail and an assembled lid which is intended to be used in a container and toy block set in accordance with this invention.
Figure 12:
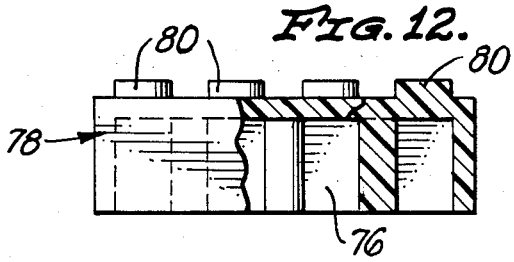
FIG. 12 is a side elevational view at an enlarged scale of a toy block for use with a container as shown in FIG. 8, this view being partially broken away so as to indicated the nature of the block illustrated.
Figure 13:
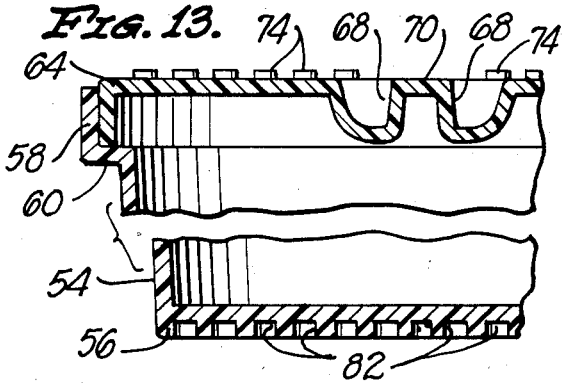
FIG. 13 is a partial cross sectional view taken at line 12—12 of FIG. 10.

In FIGS. 11 and 13 of the drawings there is shown another container 50 in accordance with this invention. This container 50 includes a receptacle or pair 52 having a peripherial sloping, conically shaped wall 54 which extends upwardly from a bottom 56 and which terminates in a an offset top 58 joined to the wall 54 by a radially extending flange or shoulder 60. Normally it is preferred to mount a handle 62 upon the offset top 58 in a conventional manner. The pail 52 is used with a lid 64 forming a part of the container 50; this lid 64 is shaped so as to include a peripheral flange 66 fitting within the top 58 against the shoulder 60. It is preferred to form the lid 64 so that it includes a pair of adjacent depressions 68 capable of being used as a handle. Preferably these depressions 68 are separated by a flat area 70 capable of receiving a label or the like.

In the container the lid 64 is preferably formed so as to include areas 72 which are provided with a pattern (not numbered) of upwardly extending, regularly spaced cylinders 74 located in rows (not numbered) extending in two different directions at right angles to one another. These cylinders 74 are capable of being interfitted within cavities or interiors 76 of known, hollow, generally rectangular blocks 78 so as to be held in place by friction. The blocks 78 are constructed so as to include other cylinders 80 corresponding to the cylinders. 74. It is also preferred—but not necessary—to form the bottom 56 so that it includes a pattern (not numbered) of cavities 82 which are capable of frictionally receiving the cylinders 80 or the cylinders 74.

Figure 14:
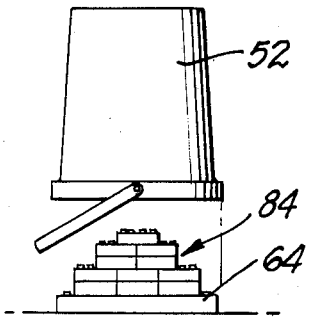

Normally the container will be supplied to a user with the pail 52 filled with a set (not shown) of the blocks 78 so that upon removal from the container the blocks 78 can be assembled together into what may be referred to as an assembly 84 in a known or conventional manner. With the present invention such an assembly 84 can be constructed directly upon the lid 64 as shown in FIG. 14. When this is done the pail 52 can be inverted and located on the lid 64 to protect such an assembly 84 as indicated in this FIG. 14 if the assembly 84 is of a reasonably confined dimension such that it will fit within the pail 52.

Figure 16:
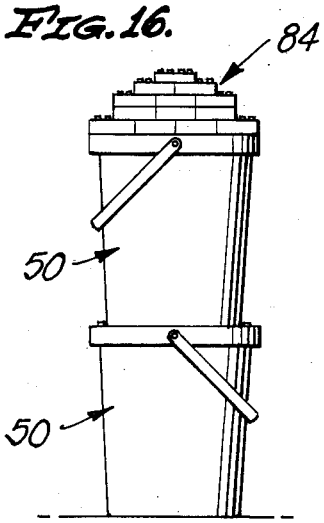
FIG. 14, 15, and 16 are diagrammatic views of a container as shown in FIG. 10.
Figure 15:
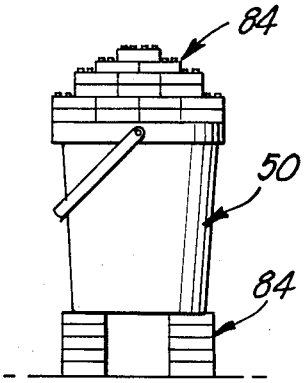

As an alternate to this when the lid 64 is in position on the pail 52 an assembly 84 can be created directly on the lid 64 so that the container 50 in effect enters into the assembly 84 as indicated in FIG. 15. This is considered to be desirable since such an assembly 84 tends to be a convenient height for common play purposes when the container 50 is approximately 20–30 cm. tall. If the bottom 56 is provided with cavities 82 one or more assemblies 84 of the blocks 78 can be used to support the bottom 56 so that the entire container 50 in effect is a part of an entire "creation" based upon the blocks 78. As an alternate when the bottoms 56 of two or more of the containers 50 are provided with such cavities 82 the containers 50 can be assembled together as indicated in FIG. 16. This can be desirable for storage as well as for play purposes. When several of such container 50 are assembled together as indicated in FIG. 16 an assembly 84 can be formed on the lid 64 of the upper most container 50 as shown. It is also possible to separate several "stacked" containers 50 by various blocks 78 or an assembly (not shown) of such blocks 78.

We claim:

1. In the combination of a pail and a lid, and a set of toy blocks, each of the blocks of said set being constructed so as to include a plurality of identical cylinders extending from a top thereof and an open interior in the bottom thereof capable of frictionally holding the cylinders on other of said blocks, said pail having a bottom a peripheral wall extending upwardly from said bottom, said peripheral wall having a top, said lid being capable of fitting against said top of said peripheral wall so as to close off the interior of said pail, the improvement which comprises:

said lid including a plurality of upwardly extending cylinders, each of said cylinders on said lid being identical to said cylinders on said blocks of said set, said cylinders on said lid being spaced from the periphery of said lid being located in a pattern such that said blocks can be assembled on said lid with the interior of the bottom of each block so held being in frictional engagement with said cylinders on said lid and with the cylinders on the top of each block so held projecting upwardly from said lid, whereby when blocks are assembled on said lid other blocks can be assembled on the blocks assembled on said lid so as to create an assembly of said blocks which is supported by said lid and whereby said assembly of said blocks can be created when said lid is removed from said pail and said pail can be inverted to cover said assembly on said lid and all of said cylinders on said lid.

2. The combination claimed in claim 1 wherein:

said peripheral wall of said pail includes a radially extending grove adjacent to said top and said lid fits against said grove when it is assembled on said pail.

3. The combination claimed in claim 1 wherein:

said bottom of said pail includes a plurality of cavity means, each of said cavity means being capable of frictionally holding one of the cylinders on one of said blocks, said cavity means being located in a pattern such that said bottom can be frictionally held by some of said blocks.

4. The combination claimed in claim 1 wherein:

said peripheral wall of said pail includes a radially extending grove adjacent to said top and said lid fits against said grove when it is assembled on said pail.

5. In the combination of a receptacle having an open top and a lid for closing said top, and a set of toy blocks, each block of said set having a square cross-sectional configuration and having notches located along its length, the notches in said blocks of said set being spaced from one another and being located on opposed sides of said blocks, in which the improvement comprises:

said lid including a plurality of identical square holes extending through said lid, said holes being located in a two dimensional rectangular pattern (1) in which the distances between the holes are the same and this distance is slightly less than the side dimension of any of the holes and (2) in which the holes adjacent to the periphery of the lid are spaced from the periphery of said lid this same distance whereby the portions of said lid between said holes will interfit within the notches in said blocks so that an assembly of blocks including the blocks interfitting with said lid and other blocks interfitting on such blocks on said lid can be created on said lid.

6. The combination claimed in claim 5 wherein:

said receptacle in a rectangular receptacle having sides and in which said sides include parallel slats extending between the top and the bottom thereof, said slats being spaced from one another said distance so as to accommodate said notches on said blocks.

7. In the combination of a receptacle having a bottom, sides and an open top and a lid for closing said top, and a set of toy blocks, each block of said set having a square cross-sectional configuration and having notches located along its length, the notches in blocks of said set being spaced from one another and being located on opposed sides of said blocks, in which the improvement comprises:

said bottom including a plurality of identical square holes extending through said bottom, said holes being located in a two dimensional rectangular pattern (1) in which the distances between the holes are the same and this distance is slightly less than the side dimension of any of the holes and (2) in which the holes adjacent to the periphery of the bottom are spaced from the periphery of said bottom this same distance whereby the portions of said bottom between said holes will interfit within the notches in said blocks so that an assembly of blocks including the blocks interlocked with said bottom can be created on said bottom.

8. The combination claimed in claim 24 wherein:

said receptacle is a rectangular receptacle in which said sides include parallel slats extending between the top and the bottom thereof, said slats being spaced from one another said distance so as to accommodate said notches on said blocks.

9. In the combination of a receptacle having an open top, a bottom and a lid for closing said top, and a set of toy blocks, each block of said set having a square cross-sectional configuration and having notches located along its length, the notches in said blocks of said set being spaced from one another and being located on opposed sides of said blocks, in which the improvement comprises:

said lid including a plurality of identical square holes extending through said lid, said holes being located in a two dimensional rectangular pattern (1) in which the distances between the holes are the same and this distance is slightly less than the side dimension of any of the holes and (2) in which the holes adjacent to the periphery of the lid are spaced from the periphery of said lid this same distance whereby the portions of said lid between said holes will interfit within the notches in said blocks so that an assembly of blocks including the blocks interfitting with said lid and other blocks interfitting on such blocks on said lid can be created on said lid, said bottom including a plurality of identical square holes extending through said bottom, said holes being located in a two dimensional rectangular pattern (1) in which the distances between the holes are the same and this distance is slightly less than the side dimension of any of the holes and (2) in which the holes adjacent to the periphery of the bottom are spaced from the periphery of said bottom this same distance whereby the portions of said bottom between said holes will interfit within the notches in said blocks so that an assembly of blocks including the blocks interlocked with said bottom can be created on said bottom.

10. The combination claimed in claim 9 wherein:

said receptacle is a rectangular receptacle having sides and in which said sides include parallel slats extending between the top and the bottom thereof, said slats being spaced from one another said distance so as to accommodate said notches on said blocks.

11. In the combination of a pail, a lid, and a set of toy construction elements, said elements of said set including a plurality of identical first connecting elements extending from some of said construction elements, said construction elements being capable of being assembled together into an assembly of said construction elements through the use of said first connecting elements and other connecting elements on said construction elements, said pail having a bottom, a peripheral wall extending upwardly from said bottom, said peripheral wall having a top, said lid being capable of fitting against said top of said peripheral wall so as to close off the interior of said pail, the improvement which comprises:

said lid including a plurality of identical upwardly extending second connecting elements, each of said first connecting elements being capable of interfitting with one of said second connecting elements, said second connecting elements on said lid being spaced from the periphery of said lid and being located in a pattern such that some of said construction elements can be assembled on said lid with the first connecting elements on the construction elements assembled on said lid being interfitted with said second connecting elements on said lid and with the construction elements so held extending upwardly from said lid, whereby when some construction elements are assembled on said lid other construction elements can be assembled on the construction elements assembled on said lid so as to create an assembly of said construction elements which is supported by said lid and whereby said assembly of said construction elements can be created when said lid is removed from said pail and said pail can be inverted to cover said assembly on said lid and all of said second connecting elements on said lid.

12. The combination claimed in claim 11 wherein:

said peripheral wall of said pail includes a radially extending grove adjacent to said top and said lid fits against said grove when it is assembled on said pail.

* * * * *